United States Patent [19]

von Hazmburg

[11] 4,020,237

[45] Apr. 26, 1977

[54] PAPER COVERED GYPSUM BOARD AND PROCESS OF MANUFACTURE

[75] Inventor: Romulis S. von Hazmburg, Laguna Hills, Calif.

[73] Assignee: United States Gypsum Company, Chicago, Ill.

[22] Filed: Sept. 22, 1975

[21] Appl. No.: 615,271

Related U.S. Application Data

[60] Continuation of Ser. No. 512,762, Oct. 4, 1974, abandoned, which is a continuation of Ser. No. 174,313, Oct. 15, 1971, abandoned, which is a continuation of Ser. No. 47,584, June 18, 1970, abandoned, which is a division of Ser. No. 612,351, Jan. 30, 1967, Pat. No. 3,562,097.

[52] U.S. Cl. ..... 428/535; 52/408; 156/39; 428/537; 428/538

[51] Int. Cl.[2] ..... B32B 13/00; B32B 29/00; B32B 31/00

[58] Field of Search ..... 52/408, 417, 612; 162/145; 428/537, 535, 538; 156/39, 44

[56] References Cited

UNITED STATES PATENTS

| | | | |
|---|---|---|---|
| 2,806,811 | 9/1957 | Von Hazmburg | 428/535 |
| 2,962,414 | 11/1960 | Arledter | 162/145 |
| 3,692,620 | 9/1972 | Schmidt et al. | 428/537 X |

*Primary Examiner*—Lorraine T. Kendell
*Attorney, Agent, or Firm*—Samuel Kurlandsky; Donnie Rudd; Kenneth E. Roberts

[57] ABSTRACT

A paper covered gypsum board and a process for its manufacture, with at least one cover of the board comprising a multiply paper sheet containing a major proportion of cellulosic fibers and a minor proportion of short mineral fibers.

8 Claims, No Drawings

PAPER COVERED GYPSUM BOARD AND PROCESS OF MANUFACTURE

This application is a continuation of U.S. Application Ser. No. 512,762, filed on Oct. 4, 1974, and now abandoned, which itself was a continuation application of U.S. Application Ser. No. 174,313, filed Oct. 15, 1971, and now abandoned, which itself was a continuation application of U.S. Application Ser. No. 47,584, filed June 18, 1970, and now abandoned, which itself was a division of U.S. Application Ser. No. 612,351, filed Jan. 30, 1967, now U.S. Pat. No. 3,562,097.

This invention relates to paper covered gypsum board and its manufacture. More particularly, it relates to improved gypsum board having a paper cover sheet in which there is incorporated mineral fibers.

As is known, paper covered gypsum board comprising a cast gypsum core and paper cover sheets is widely used in building construction as, for example, wallboard, lath and the like. In manufacturing such gypsum board the face paper is usually drawn over a forming table, a water-stucco slurry spread over the paper sheet and the back paper cover applied thereover before the slurry has set. The board is then cut to desired size and dried in a kiln. In use the board is cut to fit by scoring and snapping or by sawing and is applied by means of clips, nails, screws or adhesives.

The strength of the finished gypsum board depends to considerable extent on the paper covers employed, which paper cover sheets must be of such nature as to have characteristics to enable the board to be manufactured to close dimensional specifications, have suitable surface quality, be readily dried and form a good bond with the gypsum core.

It is an object of this invention therefore to provide an improved gypsum board having paper cover sheets having included therein a minor proportion of mineral fibers and a process for the manufacture of this board.

It is a further object of the invention to produce a plasterboard having paper cover sheets of a multiply nature in which at least some of the paper plies have incorporated therein mineral fibers.

It is another object of this invention to provide paper cover sheets which form a good bond with the core of the gypsum board and which afford economies in the manufacture of the board.

It is a still further object of this invention to provide a paper sheet of enhanced physical characteristics comprising a major portion of cellulose fibers and a minor portion of short mineral fibers.

Another object of this invention is to provide paper cover sheets which have good strength, can be readily cut and have good dimensional stability over a wide range of relative humidities.

In accordance with the present invention, improved gypsum boards are prepared by encasing a cast gypsum (calcium sulfate dihydrate) core within a multiply paper cover sheet in which at least one of the plies thereof comprises a major amount of cellulosic fibers and a minor amount of mineral fibers. The term "mineral fibers" as used herein means rock wool, slag wool and spun or drawn glass fibers and the term "cellulosic fibers" includes lignocellulosic fibers. The mineral fibers are employed in the paper cover sheet in an amount from about 2 to about 20% by weight of the entire sheet with no single ply thereof containing more than about 43% by weight of mineral fibers. More preferably, the mineral fibers are employed within a paper cover sheet within the range from about 5 to 17% by weight thereof. However, the specific amount of mineral fiber to employ in a particular case will vary somewhat depending upon the size and type of mineral fibers employed and also the characteristics desired in the finished gypsum board. Excellent paper cover sheets result when the mineral fiber content thereof ranges from about 7 to 15% by weight and this is a particularly preferred range for the mineral fiber content of the paper cover sheet.

According to one preferred embodiment of the invention multiply paper cover sheets are made by separately dispersing a mass of cellulosic fibers and mineral fibers in water, combining the two dispersions of said fibers in desired proportion and finally forming the combined fibers into a web of paper on a paper-making cylinder machine. Standard paper mill accessory equipment is suitable.

The paper cover sheet of the invention is of multiply nature with at least one of the plies thereof containing mineral fibers in the specified amounts. It is often advantageous to omit mineral fibers from the ply or plies at the finished paper surface to improve surface smoothness and the like. However, if desired all of the paper plies can contain mineral fibers in an amount within the specified range with the amount being the same or varied from ply to ply.

The length of the mineral fibers is important in achieving the desired results and a substantial proportion, that is about 80% or more of the mineral fibers present in the paper cover sheet, should not greatly exceed the length of the cellulosic fibers. It is to be understood, of course, that some attrition of fiber length may occur duing the paper-making process.

The strength and handling characteristics of the paper covered gypsum board are, of course, influenced by the compressive strength, density and brittleness of the gypsum core but the physical characteristics of the paper cover sheet exert a significant influence on the overall properties of the finished board. A substantial portion of the paper used in gypsum board manufacture is formed on cylinder machines which characteristically produce paper which is considerably stronger in the "machine direction" (direction normal to the axis of the cylinder) than in the "cross direction" (direction parallel to the axis of the cylinder) with the tensile strength ratio usually being greater than about 4:1. Because of this directional strength differential, paper cover sheets must be made having enough longitudinal strength to provide adequate cross direction strength. When this is done, the machine direction strength can be so high as to cause difficulty in scoring and cutting the board in the field (at the job site). I have now found, in accordance with the present invention, that addition of mineral fibers to paper cover sheets without any deviation in the normal paper-making machine operation tends to lessen the differential in the tensile strength of the paper in the machine direction and the cross direction thereof. Thus, use in gypsum board of paper cover sheets containing a minor proportion of mineral fibers therein results in significant improvement in quality.

Improved gypsum boards in accordance with the present invention are obtained when mineral fibers are incorporated in one or more plies of the paper sheets employed to encase the cast gypsum core. It is generally preferred that both the face and back cover sheets of the gypsum board contain a minor proportion of mineral fibers in one or more plies thereof. Preferably the paper plies in contact with the cast gypsum core contain a percentage of mineral fibers and the paper plies forming the surface of the gypsum board have little or no mineral fiber content, particularly when the surface of the gypsum board is to be decorated other than by application of plaster thereto.

The advantages of the invention will be apparent from the following specific examples which are not limitative but illustrative only.

EXAMPLE 1

A seven ply paper sheet was prepared on a cylinder machine. The furnish for the exposed or liner plies was 73% newspaper and 27% magazines. The furnish for the five filler plies was basically 85% corrugated paperboard and 15% newspaper to which was added the amount of mineral wool indicated in Table 1 below.

Mineral wool was produced on an apparatus similar to that shown in U.S. Pat. Nos. 2,587,710 and 2,646,593 and was treated lightly with an anti-dusting mineral oil and contained about 50% shot. The fibers were about 3.5 to 5 microns in diameter and a substantial proportion thereof were less than one half inch long.

The paper was prepared in a mill having separate stock systems and the liner furnish was prepared in normal manner. The mineral wool was dispersed in a hydropulper to a consistency of about 2.4% with minimum refining to avoid undue reduction in fiber length. However, hydropulping was sufficient to insure that the mineral fibers were well dispersed and did not agglomerate into bundles or clots.

At the beginning of the paper-making operation only cellulosic fibers were used in both liner and filler plies. Mineral wool was then added to the cellulosic fibers in a filler cylinder vat in an amount of about 10 to 15% of the furnish going to that vat and soon thereafter to the balance (4) of the filler cylinder vats. As the mineral wool was blended with the filler stock at the screen head box, the stock became freer and additional water was added.

Sodium aluminate together with alum was added to the filler plies to set the size. The paper containing mineral wool dried easily. The ease with which the sheets having high mineral wool concentrations were dried is illustrated by the moisture values reported in Table I.

For purposes of analysis, a small sheet of tissue paper was periodically placed between the mineral wool-free liner plies and the filler plies so that later, when the sheet had been dried, the liner plies could be readily removed. The filler plies were then ignited at 1000° F. and the ash reported as percent mineral wool in Table I. The values have been rounded off so the figures reported are consistent with the accuracy of the analysis.

TABLE I

MINERAL WOOL PAPER CHARACTERISTICS

| | | | | | | |
|---|---|---|---|---|---|---|
| Percent Wool | | | | | | |
| Filler Plies | 0 | 10–12 | 15–17 | 18–20 | 28 | 33–46 |
| Total Sheet | 0 | 7–9 | 11–12 | 13–14 | 20 | 27–33 |
| Basis Weight (Pounds per Thousand Sq. Ft.) | 73.1 | 70.5 | 74.3 | 72.7 | 68.7 | 68.1 |
| Caliper in 0.001 In. | 20 | 21 | 21 | 21 | 21 | 21 |
| Tensile Strength (Pounds/Inch of Width Machine Direction) | 107 | 123 | 115 | 112 | 98.3 | 45 |
| Corrected to Uniform Basis Weight | | 127 | 113 | 113 | 106 | 49 |
| Tensile Strength (Pounds/Inch Cross Direction) | 27 | 30 | 28 | 27.8 | 26.3 | 20 |
| Corrected to Uniform Basis Weight | | 31 | 27.5 | 28 | 26.3 | 21.5 |
| Moisture % by Weight | 7.5 | 5.8 | 7.0 | 5.2 | 4.3 | 3.6 |
| Porosity* | 180 | 168 | 160 | 144 | 142 | 60 |
| Shot, % of Ash | — | 14.3 | 19.6 | — | 16.9 | 20.1 |

*Porosity determined using a Gurley Densometer in accordance with Technical Association of the Pulp and Paper Industry Standards T460m-49.

Referring to Table I it will be noted that the tensile strength of the paper in the machine direction and also in the cross direction when these values are corrected for the weight of the sheet increased when mineral wool in an amount between about 10 and 20% was utilized and the tensile strength did not decrease until the percentage of mineral wool in the plies was greater than 28%.

A considerable amount of shot was separated from the mineral wool when it was dispersed in water in the hydropulper. The remaining shot, reported in Table I, was determined by gently brushing the residual matrix of mineral fibers from the ignited ash through a 325 mesh screen, and recovering the shot on the screen. The fibers recovered were about one-sixteenth to one thirty-second inch long.

The papers of Example 1 having plies containing 28% and 46% mineral wool were made into gypsum board using normal board forming machinery and processing. No difficulty was encountered in forming the board with either paper when used as face and back paper. Width expansion was slightly less with the mineral wool papers than with regular paper which might have been expected since the shrinkage had been less with the mineral wool paper on the paper machine. Because of the increased porosity of the mineral wool paper the board dried more easily and the temperature in the drying kiln can be 15° to 20° F. lower than normal. Board made with 28% mineral wool plies was generally satisfactory but that made with 46% mineral wool was below specifications as set forth in ASTM-C 36 when measured parallel to the long edge of the board although the strength measured across the board was satisfactory. The bond of the paper to the core was good and there was no tendency for the mineral wool paper to cockle either in the face sheet or back sheet. The lack of cockles in the face sheet is extremely desirable in a quality board and their absence on the back sheet was highly surprising as some cockles are usually present when board is made with all cellulosic fibers in the back sheet.

The term cockle is applied to a quality defect in finished board and refers to a depression having its length parallel to the machine direction which probably results from the presence of more lineal inches of paper in the depressed area than in the adjacent flat portions. The excess of paper may occur because of non-uniform formation on the paper machine or from an excess of moisture which has caused the paper to expand unevenly. Variation of moisture content may result from poor drying of the sheet on the paper machine or from some paper defect which permits moisture from the gypsum slurry to penetrate the sheet more freely in some places than in others. The increased uniformity of formation resulting from the addition of mineral fibers to the board paper enables the production of quality board with a minimum of cockles.

The porosity of paper as determined using a Gurley Densometer in accordance with Technical Association of the Pulp and Paper Industry Standards T460m-49 is reported as the number of seconds required for a specified quantity of gas to pass through a specified area of the sheet; a numerically higher porosity value therefore indicates a more dense sheet. The porosity of the paper cover sheets is very important in gypsum board manufacture because to considerable extent it controls the ease with which finished wallboard can be dried in the kiln since all of the free water contained in the gypsum board core must be driven through the sheet of paper as water vapor. A sheet which is too dense will be blown off the board in the kiln by the pressure built up beneath it. The inclusion of 2% or more of mineral fiber in the paper sheets produced a highly desirable reduction in the resistance to passage of gas through the sheet.

The improvement in porosity which is achieved with the addition of small amounts of mineral wool fibers is illustrated by the following example.

EXAMPLE 2

Two hundred square centimeter handsheets weighing 2.4 grams were prepared by the Technical Association of the Pulp and Paper Industry method T-205 from a furnish made up of 65% corrugated paperboard and 35% newspaper; the corrugated paperboard having been beaten for the time indicated. The cellulosic fibers were dispersed separately to approximately 0.3% consistency and to this was added a mineral fiber furnish at about 0.2% consistency in sufficient quantity to give the desired fiber content. The effect on the porosity of the sheet produced by both mineral fibers and glass fibers is indicated in Table II.

TABLE II

POROSITY OF PAPER

Mineral Wool Fibers Added to Cellulosic Fibers (65% corrugated paper board - 35% newspaper)

| Corrugated Beat, Minutes | | | 0 | | | | 4 | | | | | 8 | | | |
|---|---|---|---|---|---|---|---|---|---|---|---|---|---|---|---|
| Mineral Wool - % | 0 | 2 | 8 | 16 | 50 | 0 | 2 | 8 | 16 | 50 | 0 | 2 | 8 | 16 | 50 |
| Porosity* (Resistance to Gas Passage) | 17 | 16 | 12 | 6 | 1 | 24 | 26 | 14 | 7 | 1 | 31 | 25 | 14 | 8 | 1 |
| Ash | 1.9 | 3.3 | 9.8 | 19.6 | 54.5 | 1.3 | 3.2 | 9.9 | 18.4 | 50.9 | 1.0 | 3.1 | 9.6 | 20.4 | 53.2 |
| Glass Fiber - % | 0 | 2 | 8 | 16 | 50 | 0 | 2 | 8 | 16 | 50 | 0 | 2 | 8 | 16 | 50 |
| Porosity* (Resistance to Gas Passage) | 18 | 15 | 10 | 6 | 1 | 24 | 19 | 15 | 8 | 1 | 28 | 22 | 15 | 9 | 1 |
| Ash | 1.7 | 3.2 | 9.7 | 18.2 | 52.1 | | | | | | | | | | |

*Porosity determined using a Gurley Densometer in accordance with Technical Association of the Pulp and Paper Industry Standards T460m-49.

It will be noted that the sheet became much more porous as the percentage of mineral fiber added was increased and that as little as 2% mineral fiber produced a significant reduction in the resistace to gas passage.

Samples of the paper were ignited and the mineral fiber mat recovered and examined to determine the mineral fiber length and diameter. The mineral wool fibers were uniformly distributed and were about 5 microns in diameter and had an average length of about one-sixteenth inch; the diameter of the glass fibers showed some variation but generally were less than about 5 microns with an average of 2.5 microns and a length of one thirty-second inch. The fibers were reduced to such relatively short lengths by the action of the beater in dispersing them in water since they had been considerably longer when introduced into the system. The glass fibers were present as individual elements and not as bundles or groups.

EXAMPLE 3

Using a multicylinder paper machine a seven ply sheet with a basis weight of about 72 pounds per 1000 square feet was made in which the top liner consisted of two plies made from a furnish comprising 73% newspaper and 27% magazine paper; the four filler plies and the bond ply, i.e. the ply eventually to lie next to the board core, comprised 80% corrugated paperboard and 20% newspaper to which was added about 12 ½% mineral wool. This paper was made into satisfactory board without difficulties and there were no cockles on either the face of back of the boards and the bond to the core was good.

A second and heavier paper with a basis weight of about 120 pounds per 1000 square feet was made with 31% mineral wool in the four filler plies and bond ply and it too was satisfactorily made into board, although there were indications that the extra weight of this paper resulted in gypsum board so strong that some difficulty could perhaps be encountered in installing the board.

The properties of papers made according to Example 1 and Example 3 are summarized in Table III and illustrate the reduction in differential between the tensile strength of the paper in the machine direction and cross machine direction. The change in ratio is very evident in the paper of Example 3 wherein addition of 12.5% mineral wool reduced this tensile strength ratio from 4.0 to 3.35 and 31% mineral wool reduced it further to 2.62.

TABLE III

MACHINE DIRECTION/CROSS DIRECTION TENSILE RATIO

| Ply Orientation | Example 1 | | | | | | | Example 3 | | |
|---|---|---|---|---|---|---|---|---|---|---|
| % Wool Filler Plies | 0 | 0 | 10–12 | 15–17 | 18–20 | 28 | 38–46 | 0 | 12.5 | 31 |

TABLE III-continued

| MACHINE DIRECTION/CROSS DIRECTION TENSILE RATIO | | | | | | | | | | |
|---|---|---|---|---|---|---|---|---|---|---|
| Total Sheet | 0 | 0 | 7–9 | 11–12 | 13–14 | 20 | 27–33 | 0 | 9 | 22 |
| Tensile | | | | | | | | | | |
| Machine Direction | 106 | 107 | 123 | 115 | 112 | 98 | 45 | 112 | 87 | 100 |
| Cross Direction | 25 | 27 | 30 | 28 | 27.8 | 26 | 20 | 28 | 26 | 38 |
| Ratio | 4.25 | 3.96 | 4.1 | 4.1 | 4.0 | 3.76 | 2.25 | 4.0 | 3.35 | 2.62 |

EXAMPLE 4

Lath paper was made from furnish similar to that used in Example 3 with the exception that the top liner (2 plies) contained 25% mineral wool in one case and 43% mineral wool in a second case. The amount of wool in the entire paper sheets was 16% and 22% respectively.

The papers of Example 4 were formed into paper covered gypsum lath with no cockling. It was noted, however, that the papers appeared to be somewhat rougher than paper without mineral fiber and the board with 43% mineral fiber in the top liner was noted to cause some skin irritation. No difficulty was encountered with handling and nailing the laths and the bond of sanded plaster was good.

The lath papers of Example 4 possessed desirable water absorption characteristics without the addition of a surface active agent regularly required for this purpose with cellulosic paper. Elimination of this ingredient is advantageous because its concentration must be carefully controlled and its effect tends to diminish with age and on passage through the drying kiln, thus causing undesirable variation in paper quality. The proper amount of absorption is important on lath paper; if absorption is too low plaster will not stick to the latch when it is applied and if absorption is too high, the latch will remove so much water from the plaster that the plaster will be difficult to trowel and not set properly.

In making the sheet of Examples 3 and 4 the paper was 157 inches wide at which width a shrinkage on the paper machine up to 2 inches is considered "normal". It was observed that when the paper sheet contained mineral fibers the shrinkage was only about 1 inch. Moreover, in order to control sheet dryness it was possible to reduce the steam pressure to about 50% of normal value while maintaining the machine speed.

It will be understood that the examples set out above are intended to be illustrative and not limiting and that modifications and variations may be effected without departing from the spirit and scope of the novel concepts of the present invention.

I claim:

1. A gypsum board comprising a core of cast gypsum and having a porous paper cover sheet formed of a plurality of plies, said paper cover sheet consisting essentially of a major proportion of cellulosic fibers and a minor proportion of mineral fibers in an amount of from about 2 to 20% by weight of said paper cover sheet with the amount of mineral fibers in any one ply of said paper cover sheet not exceeding about 43% by weight thereof.

2. A gypsum board in accordance with claim 1 wherein a ply of said cover sheet containing said mineral fibers is in contact with the cast gypsum core.

3. A gypsum board in accordance with claim 1 having a multiply paper cover sheet containing in a plurality of plies thereof mineral fibers in an amount from about 2 to 20% by weight of said paper cover sheet with the amount of said mineral fibers in any one ply not exceeding about 43% by weight thereof.

4. A gypsum board comprising a core of cast gypsum having face and back porous paper cover sheets therefor, each of said sheets being formed of a plurality of plies and consisting essentially of a major proportion of cellulosic fibers and a minor proportion of mineral fibers in an amount from about 2 to 20% by weight of each of said paper cover sheets with the amount of mineral fibers in any one ply not exceeding about 43% by weight thereof.

5. A gypsum board in accordance with claim 4 wherein said plies of said cover sheets containing mineral fibers are in contact with the cast gypsum core.

6. A gypsum board in accordance with claim 4 containing mineral fibers in a plurality of plies of each of said back and face cover sheets, the mineral fibers being employed in an amount from about 2 to 20% by weight of each of said paper cover sheets with the amount of mineral fibers in any one ply of said paper cover sheets not exceeding about 43% by weight thereof.

7. A gypsum board in accordance with claim 4 wherein the exposed surface ply of each of said face and back cover sheets contains less mineral fiber than other plies of said cover sheets.

8. A gypsum board in accordance with claim 7 wherein the exposed surface plies of said face and back cover sheets are substantially free of mineral fiber.

* * * * *